US008041234B2

(12) United States Patent
Kerxhalli et al.

(10) Patent No.: US 8,041,234 B2
(45) Date of Patent: Oct. 18, 2011

(54) METHOD AND APPARATUS FOR SENSING LOCATIONS ON A BELT

(75) Inventors: David Mark Kerxhalli, Rochester, NY (US); Norman David Robinson, Jr., Rochester, NY (US); James Joseph Teich, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 399 days.

(21) Appl. No.: 12/166,355

(22) Filed: Jul. 2, 2008

(65) Prior Publication Data

US 2010/0003037 A1 Jan. 7, 2010

(51) Int. Cl.
*G03G 15/00* (2006.01)

(52) U.S. Cl. ..... 399/9

(58) Field of Classification Search ..... 399/9, 297, 399/302, 303, 308, 312, 8, 31
See application file for complete search history.

(56) References Cited

U.S. PATENT DOCUMENTS

| | | | | |
|---|---|---|---|---|
| 5,819,140 | A * | 10/1998 | Iseki et al. | 399/165 |
| 7,308,213 | B2 * | 12/2007 | Sudo et al. | 399/51 |
| 2004/0009019 | A1 * | 1/2004 | Hosokawa | 399/301 |
| 2005/0238371 | A1 * | 10/2005 | Sudo et al. | 399/38 |
| 2005/0286930 | A1 * | 12/2005 | Sawai et al. | 399/167 |
| 2006/0184258 | A1 * | 8/2006 | Matsuda et al. | 700/56 |

FOREIGN PATENT DOCUMENTS

| | | | |
|---|---|---|---|
| JP | 06130775 | A * | 5/1994 |
| JP | 09096941 | A * | 4/1997 |
| JP | 2005024934 | A * | 1/2005 |

* cited by examiner

*Primary Examiner* — Quana M Grainger
(74) *Attorney, Agent, or Firm* — Oliff & Berridge, PLC

(57) ABSTRACT

Aspects of the disclosure can provide a sensor system. The sensor system can include a belt having an undesirable portion and an aperture formed at a distance from the undesirable portion, a reflector located in the aperture, and a detector that senses a light reflected by the reflector to determine a location of the undesirable portion.

19 Claims, 6 Drawing Sheets

METHOD AND APPARATUS FOR SENSING LOCATIONS ON A BELT

BACKGROUND

A printing system may include various sensors to monitor parameters of the printing system in order to ensure satisfactory printing performance. For example, a printing system may include paper sensors that can detect the location of a piece of paper, such as whether the piece of paper is in position and ready for a printing operation. In such an example, the printing operation can be delayed until a properly positioned piece of paper is detected. The printing system may also include a belt seam sensor that can be used to detect a connecting seam of a belt, such as an intermediate transfer belt, a photoreceptor belt, and the like. Based on the output of such a sensor, printing operations can avoid the connecting seam to ensure satisfactory printing performance.

SUMMARY

Aspects of the disclosure can provide a sensor system having improved sensing accuracy. Further, the sensor system can be implemented with a reduced cost. The sensor system may provide additional benefits, such as ease of manufacture, ease of maintenance, and the like.

The sensor system can include a belt having an undesirable portion and an aperture formed at a distance from the undesirable portion, a reflector located in the aperture, and a detector that senses a light reflected by the reflector to determine a location of the undesirable portion.

According to the disclosure, the belt can include at least one of a photoreceptor belt and an intermediate transfer belt. Further, the undesirable portion can include a belt seam. The reflector may have a high reflectivity.

In an embodiment, the reflector is attached at a back surface of the belt. Further, the reflector may include a reflective sticker.

In another embodiment, the reflector can be located at an intermediate layer of the belt.

Aspects of the disclosure can also provide a method for sensing. The method can include emitting a light onto a belt having an undesirable portion and an aperture that is formed at a distance from the undesirable portion, wherein a reflector is located in the aperture, detecting the light reflected from the belt, and determining the undesirable portion based on the light reflected by the reflector.

In addition, aspects of the disclosure can provide a printing system. The printing system can include a belt having an undesirable portion and an aperture formed at a distance from the undesirable portion, a reflector located in the aperture, a driver coupled to the belt to drive the belt through image forming devices to form an image on the belt, and a detector that senses a light reflected by the reflector to determine a location of the undesirable portion in order to avoid forming the image on the undesirable portion.

EMBODIMENTS

Figure 1:
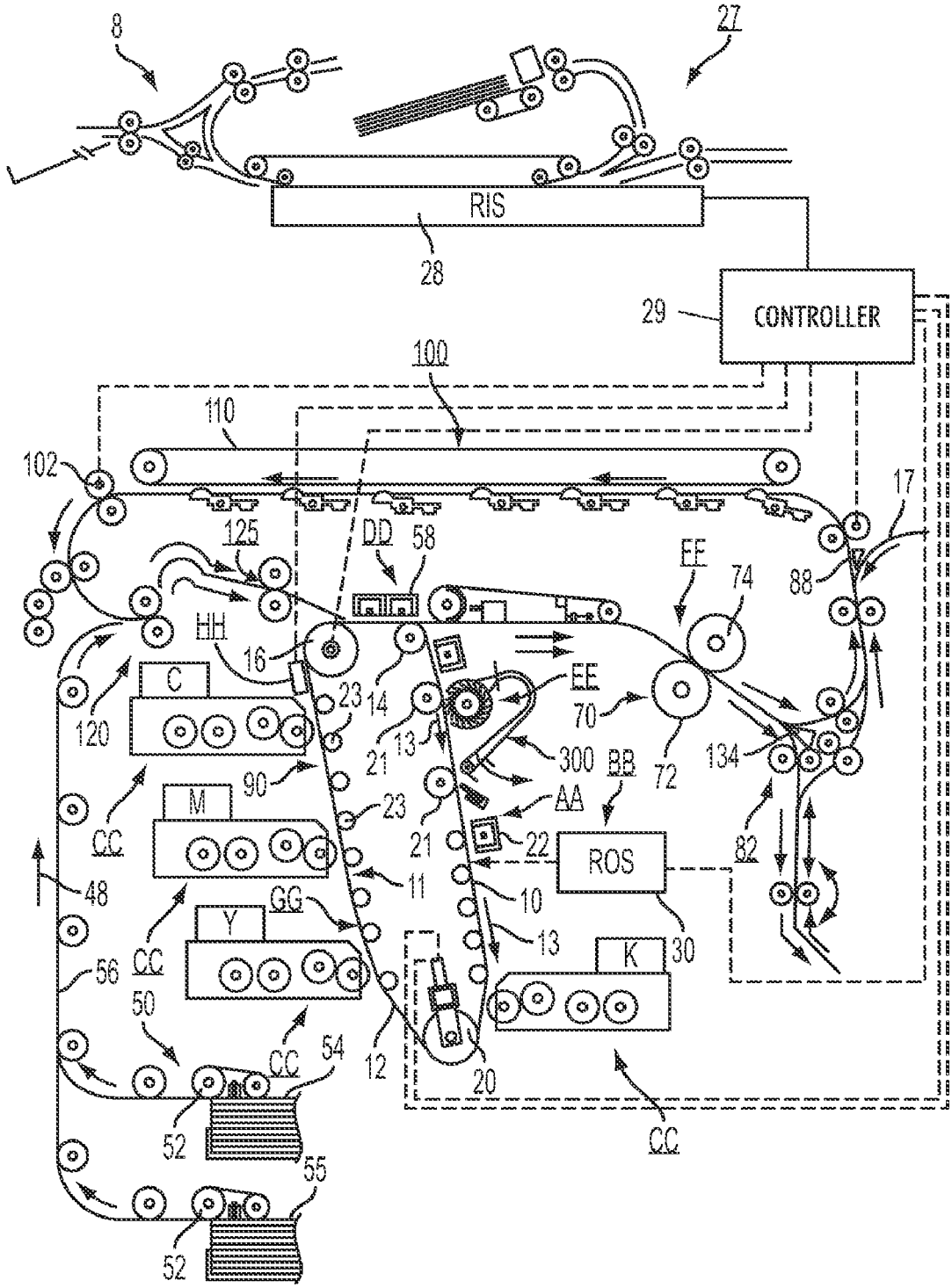
FIG. 1 shows a schematic elevational view of an exemplary printing system.

FIG. 1 shows a schematic elevational view of an exemplary printing system according to the disclosure. The printing system 100 can include various components, such as a photoreceptor belt GG, a cleaning system EE, a charging system AA, an exposing system BB, a developing system CC, a transferring system DD, a fusing system FF, and the like, that support creating a desired image. In addition, the printing system 100 can include various sensors that can sense parameters of the printing system 100. For example, the printing system 100 can include a belt seam sensor system, which may include a sensor HH coupled with the photoreceptor belt GG, to sense a connecting seam of the photoreceptor belt GG. These elements can be coupled together as shown in FIG. 1.

The photoreceptor bet GG can be fabricated from a sheet including a plurality of layers, such as a substrate layer, an electrically conductive layer, an adhesive layer, a charge generating layer, and the like. In an example, the sheet of the plurality of layers may have a rectangular shape, and can be formed into a belt by joining opposite ends of the sheet by any suitable means.

The photoreceptor belt GG may have an undesirable portion. For example, the joining process may leave a connecting seam extending across the belt width. The connecting seam may present a discontinuity in the plurality of layers, and thus may present a discontinuity in a print if a printing operation is conducted at or adjacent the connecting seam. Therefore, it may be desired that printing operations can be conducted avoiding the connecting seam.

In operation, the photoreceptor belt GG can be driven to move at a predetermined velocity. However, minor variations in driving components, for example, a driving motor speed variation due to variations in a power supply voltage, may result in position variations of the printing operations. These variations can be accumulated and result in conducting a printing operation at the connecting seam. In order to detect and avoid the connecting seam, a belt seam sensor system can be utilized.

According to the disclosure, the belt seam sensor system, which can be implemented by suitably coupling the sensor HH to the photoreceptor belt GG by the disclosed method, can detect the connecting seam with an improved accuracy and a reduced cost. Additionally, the belt seam sensor system can provide benefits, such as ease of manufacture, ease of installation, ease of maintenance, and the like.

Further, the belt seam sensor system may provide the detected belt seam position to a controller, such as a controller 29 shown in FIG. 1. Such controller 29 can be coupled to various components of the printing system 100. Therefore, when the photoreceptor belt GG, for example, moves in a direction of arrow 13 to advance successively to the various components of the printing system 100, the controller 29 may instruct the various components to perform printing operations avoiding the connecting seam.

The cleaning system EE can remove particles, such as residue toner particles, from the surface of the photoreceptor belt GG. The charging system AA can prepare the surface of the photoreceptor belt GG with electrical charges for subsequent printing process. More specifically, the charging system AA can produce electric fields, such as corona, to charge the surface of the photoreceptor belt GG to a substantial uniform potential.

The exposing system BB can include a light emitting device, such as a semiconductor laser device, to emit a light beam having an intensity corresponding to a color density of a desired image. The light beam can pass through an optical system and scan the surface of the photoreceptor belt GG. Therefore, the electric potential of the photoreceptor belt GG can be modified by the light beam to create an electrostatic latent image. The developing system CC may include a plurality of developers, for example, four developers K, Y, M and C in FIG. 1. A developer can bring a developing material, such as toner particles, in contact with the electrostatic latent image on the surface of the photoreceptor belt GG. The toner particles can be attracted to the surface of the photoreceptor belt GG according to the electrostatic latent image to create a toner image.

The transferring system DD can then transfer the toner image from the surface of the photoreceptor belt GG to a supporting sheet, such as a piece of paper. Further, the fusing system FF can permanently fuse the toner image on the supporting sheet.

During operation, for example, the sensor HH can detect the connecting seam and provide information regarding location of the connecting seam to the controller 29. The controller 29 may determine a printing location of the photoreceptor belt GG that can be a distance away from the detected connecting seam. Further, the controller 29 may enable the other components to conduct printing operations at the printing location. For example, the photoreceptor belt GG may be driven to move, such that the printing location can turn to the cleaning system EE. The cleaning system EE can operate under instructions of the controller 29 to, for example, remove residue toner particles from a previous printing. Then, the printing location can move to the charging system AA. The charging system AA can operate under instructions of the controller 29 to, for example, charge the printing location to a substantially uniform potential under instructions of the controller 29. Subsequently, the printing location can move to the exposing system BB. The exposing system BB can operate under instructions of the controller 29 to, for example, dissipate the charge on the printing location according to a desired image to produce an electrostatic latent image.

Further, a developer of the developing system CC can operate under instructions of the controller 29 to, for example, apply toner particles to the printing location. The toner particles can adhere to the printing location according to the electrostatic latent image, thereby create a toner image. The toner image can then be transferred to a supporting sheet.

In another embodiment, a printing system may include an intermediate transfer belt that can be fabricated in a similar manner as the photoreceptor belt GG, and thus can have a connecting seam. The intermediate transfer belt may temperately hold a plurality of toner images transferred from photoreceptor components, such as photoreceptor drums. Then, the intermediate transfer belt can transfer the plurality of toner images to a supporting sheet, such as a piece of paper. Similarly, it is preferred that the plurality of toner images can be held at a location of the intermediate transfer belt that is a distance away from the connecting seam. Therefore, a belt seam sensor system, which can include a sensor coupled to the intermediate transfer belt, can be implemented according to the disclosed method, which can detect the connecting seam with an improved accuracy and a reduced cost.

While the embodiments illustrate the disclosure by sensing connecting seams of photoreceptor belts and intermediate transfer belts, it should be noted that suitable locations other than the connecting seams, such as a defected location, can be sensed in a similar manner. Additionally, it should be noted that locations of suitable belts other than the photoreceptor belts and the intermediate transfer belts can be sensed in a similar manner.

Figure 2:
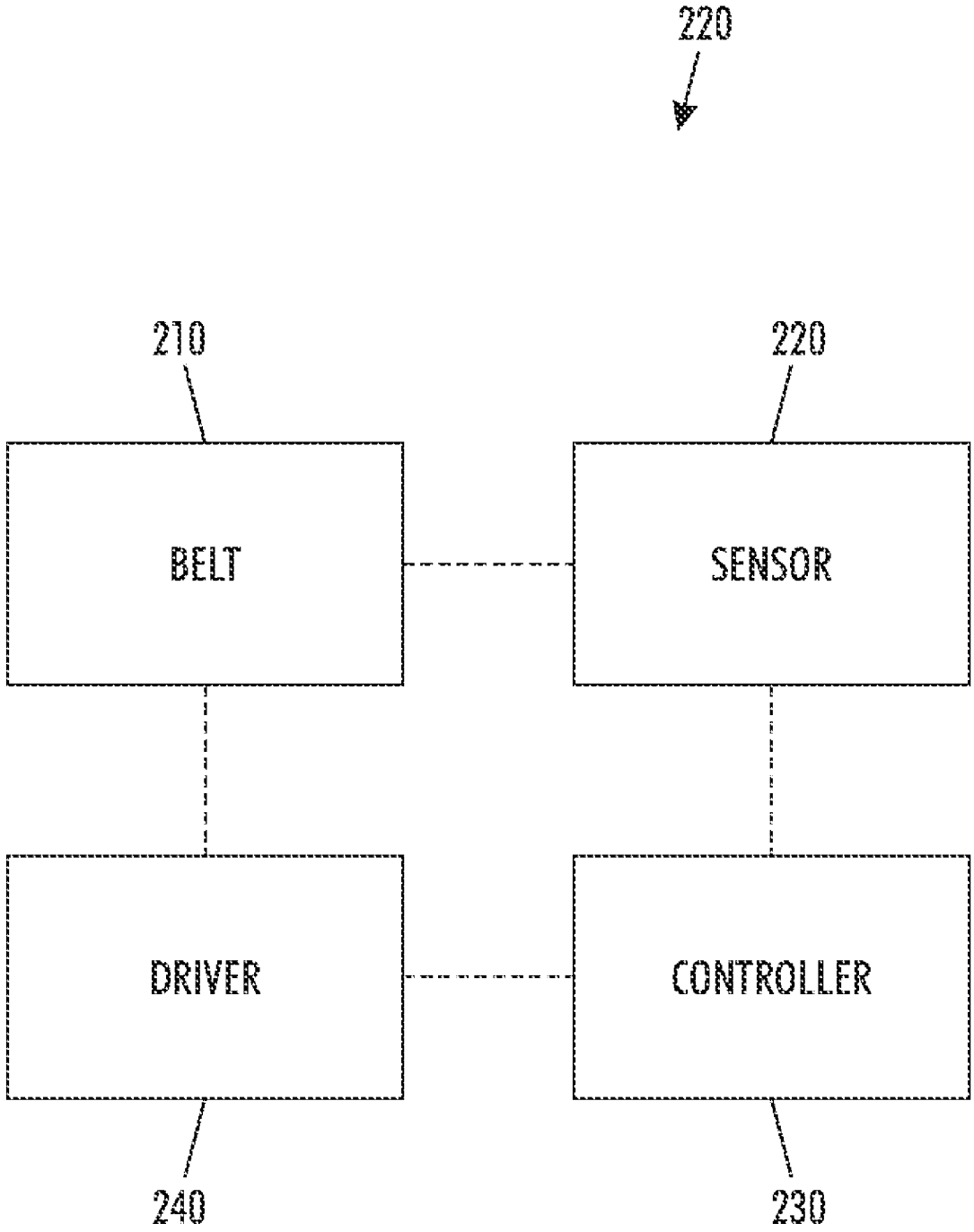
FIG. 2 shows a block diagram of an exemplary belt system.

FIG. 2 shows a block diagram of an exemplary belt system. The belt system may include a belt 210, a sensor 220, a controller 230 and a driver 240. These elements can be coupled together as shown in FIG. 2.

The belt 210, for example a photoreceptor belt, may include a location, such as a connecting seam location, that can be undesirable, for example for printing. It may be preferred that operations, such as printing operations, can be conducted at locations that are a distance away from the undesirable location. The driver 240 may drive the belt 210 to move to other printing components (not shown), which can perform the operations on the belt 210.

The sensor 220 can sense a property, such as transmissive property, reflective property, and the like, of the belt 210 in order to detect the undesirable location. Generally, the sensor 220 may include a light emitter and a light detector. The light emitter may emit a light directing to a location of the belt 210. The light can be modified according to a property at the location. The modified light can be detected by the light detector.

Various sensors can be utilized in order to detect the undesirable location. For example, a transmissive sensor can be utilized to detect the undesirable location by detecting a transmissive light. In another example, a reflective sensor can be utilized to detect the undesirable location by detecting a reflective light. A suitable sensor may be chosen considering various factors, such as cost, ease of manufacture, ease of installation, ease of maintenance, and the like. In an embodiment, a reflective sensor can be preferred. The reflective sensor may have a low cost. Additionally, the reflective sensor may provide design flexibility, and ease of integration with other components. Moreover, the reflective sensor may exist in an older version of a system, and thus can be preferred to simplify a system design, and reduce a design cycle.

The sensor 220 can be coupled to the controller 230, and provide signals corresponding to the undesirable location to the controller 230. Accordingly, the controller 230 may control the driver 240 and the other components to ensure that, for example, the printing operations are performed on locations of the belt 210 that are away from the undesirable location.

Generally, a portion of the belt 210 maybe modified to assist the sensor 220 to detect the undesirable location. For example, an aperture can be cut at a predetermined location of the belt 210. The aperture can modify a transmissive property at the predetermined location to assist a transmissive sensor. The transmissive sensor may detect the predetermined location by detecting a transmitted light through the aperture. In an embodiment, an aperture can be accurately positioned and cut by an existing technique.

In another example, a reflective sticker can be attached to a predetermined location of the belt 210. The reflective sticker can modify a reflective property at the predetermined location to assist a reflective sensor. The reflective sensor may detect the predetermined location by detecting a reflected light by the reflective sticker. However, it can be costly to accurately shape and accurately position the reflective sticker.

To achieve an increased accuracy with a reduced cost, the disclosure can provide a sensor system implemented by coupling a reflective sensor with a belt, a portion of which can be removed at a predetermined location to expose a reflector. More specifically, the reflector can be added to the predetermined location where the portion is removed.

In an embodiment, an aperture can be cut at a predetermined location of the belt 210. Subsequently a reflective sticker can be added such that a reflective surface can be exposed through the aperture. Therefore, a reflective sensor can be used to detect the predetermined location by detecting a reflected light from the reflective surface exposed through the aperture. Because techniques exist for cutting the aperture accurately within the belt 210, the reflective sticker is not required to be accurately shaped and accurately positioned.

Figure 3A:
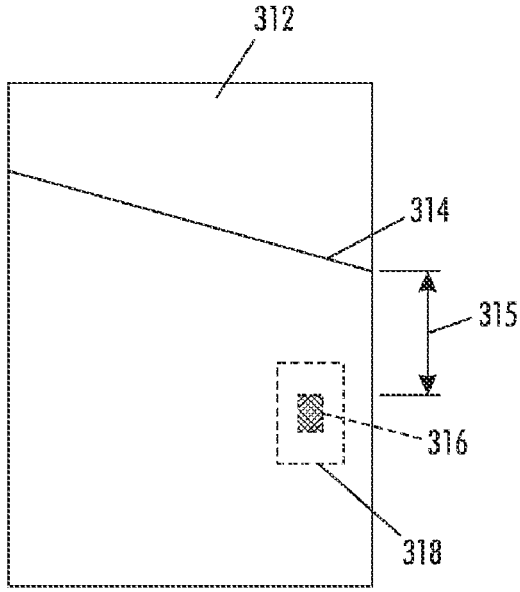
FIGS. 3A and B show front view and side view of an exemplary belt.
Figure 3B:
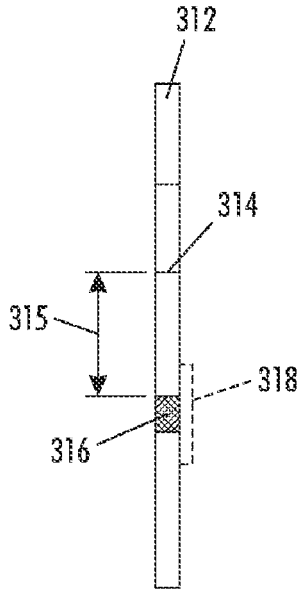

FIGS. 3A and B show a front view and a side view of an exemplary belt according to the disclosure. The belt 312 may include, for example, a connecting seam 314 that can be undesirable for printing operations.

According to the disclosure, a portion of the belt 312 at a predetermined location, for example a location having a specific distance to the connecting seam 314, may be removed to expose a reflector that can be detectable. In an example, an aperture 316 can be cut in the belt 312 at the predetermined location, for example with a predetermined distance 315 away from the connecting seam 314. Thus, when the aperture 316 is detected, the connection seam 314 can be determined.

Further, a reflector, which is reflectively detectable, can be added at the location of the aperture 316. For example, a reflective sticker 318 can be attached at a back surface of the belt 312, such that a reflective surface can be exposed through the aperture 316. As seen by FIG. 3A, a length and a width of the reflective sticker 318 are significantly less than a respective length and a respective width of the belt 312.

According to the disclosure, the aperture 316 can be cut with a high accuracy and a low cost. Further, the reflective sticker 318 is not required to be accurately shaped and positioned, and thus can be shaped and positioned with a reduced cost. Additionally, a reflective sensor can be used to detect the aperture 316. Therefore, the sensor system can be implemented with a reduced cost and an improved accuracy.

Figure 4A:
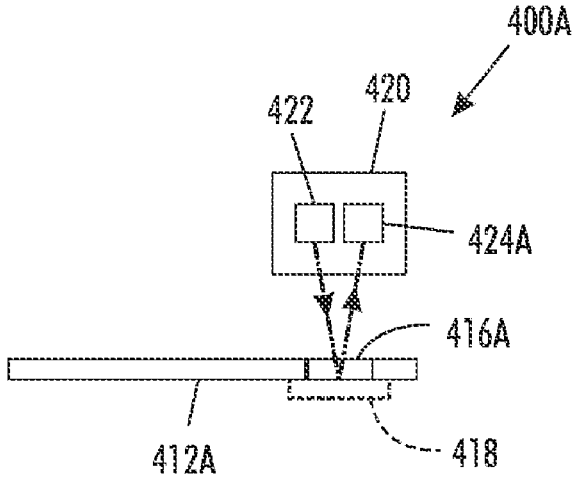
FIGS. 4A and B show a comparison of an exemplary sensor system according to the disclosure, and a conventional sensor system.
Figure 4B:
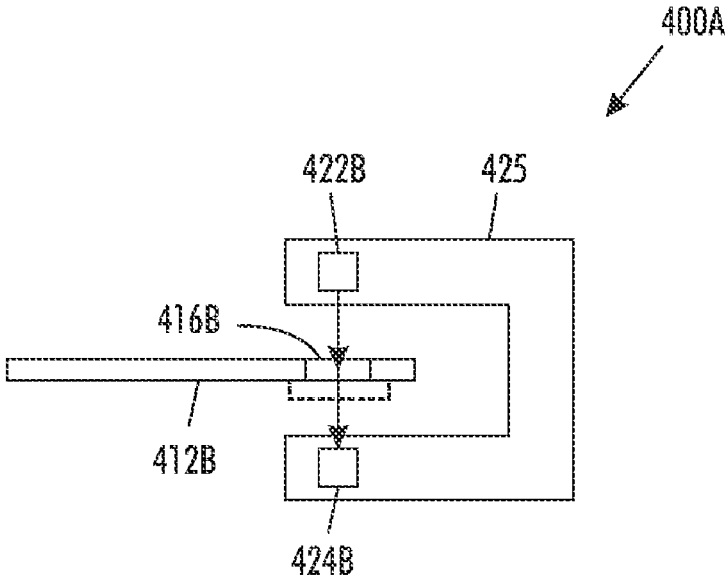

FIGS. 4A and 4B show a comparison of an exemplary improved sensor system 400A according to the disclosure and a conventional sensor system 400B. The improved sensor system 400A can include a reflective senor 420 coupled with a belt 412A. The belt 412A can include an aperture 416A with a reflective sticker 418 attached to a back side. The conventional sensor system 400B can include a transmissive sensor 425 coupled to a belt 412B, which includes an aperture 416B.

The reflective sensor 420 can further include an emitter 422A and a detector 424A coupled together as shown in FIG. 4A. The emitter 422A can emit a light directed to the belt 412A. The light can be reflected by the belt 412A surface or the reflective sticker 418. The reflected light can be detected by the detector 424A. The detector 424A may determine the aperture 416A position based on, for example, an intensity of the reflected light.

On the other hand, the transmissive sensor 425 can further include an emitter 422B and a detector 424B coupled together as shown in FIG. 4B. The emitter 422B can emit a light directed to the belt 412B. The light can transmit the belt 412B or the aperture 416B. The transmitted light can be detected by the detector 424B. The detector 424B may determine the aperture 416B position based on, for example, an intensity of the transmitted light.

The transmissive sensor 425, which may have a U-shape, can make an integration of the sensor system 400B with other components of a printing system complicated. Generally, a U-shape sensor may need to be placed in a specific manner, such as on an inboard side of the printing system. The specific manner may complicate maintenance operations, such as belt installation. One the other hand, the reflective sensor 420, which can be installed on an inboard or an outboard side of the printing system, can provide design flexibility and ease of maintenance.

Figure 5:
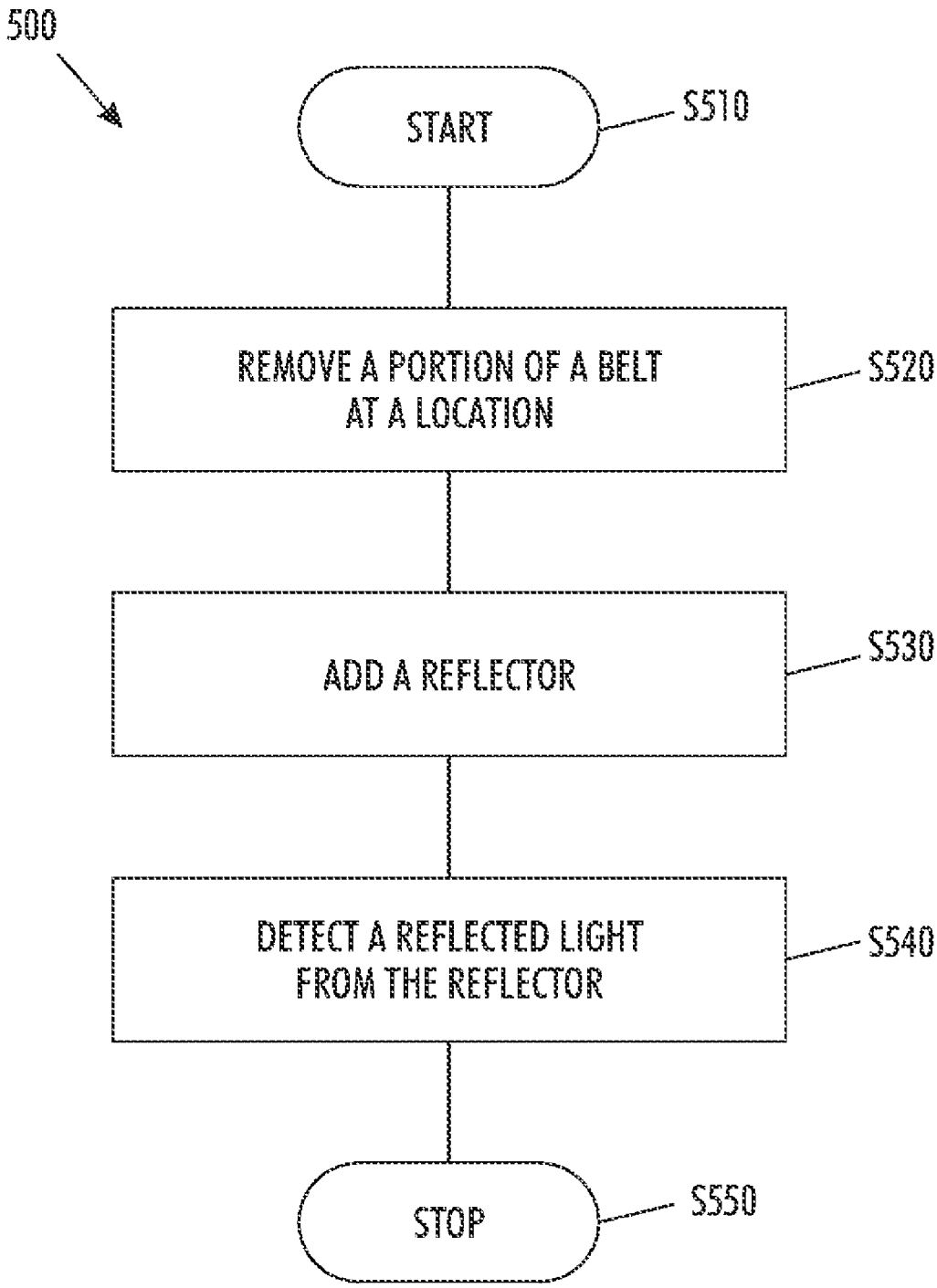
FIG. 5 shows a flowchart outlining an exemplary sensor implementation process.

FIG. 5 shows a flowchart outlining an exemplary sensor implementation process. The process starts at step S510, and proceeds to step S520. In step S520, a portion of a belt at a predetermined location can be removed. For example, an aperture can be cut at the predetermined location of the belt. In an embodiment, an aperture can be cut at a location that is a distance from a connecting seam of the belt. Then, the process proceeds to step S530.

In step S530, a reflector, which can be reflectively detectable, can be added at the predetermined location. In an example, a reflective sticker that has a high reflectivity can be attached at a back side of the belt at the aperture location, such that a reflective surface of the reflective sticker can be exposed through the aperture. Subsequently, the process proceeds to step S540.

In step S540, a sensor can be used to detect a reflected light in order to detect the aperture at the predetermined location. For example, a reflective sensor can be coupled with the belt. The reflective sensor may emit a light to the belt, the light can be reflected by the belt surface or the reflector. The reflector, such as a reflective sticker, may have a high reflectivity, which may result in a large light intensity detected by the reflective sensor. Thus, the reflective sensor can detect the aperture.

Further, the sensor may provide information corresponding the aperture at the predetermined location to a controller. The controller can then determine, for example, the connecting seam of the belt based on the information. Further, the controller may instruct other components, for example, of a printing system to perform printing operations avoiding the connecting seam. The process then proceeds to step S550 and terminates.

Figure 6:
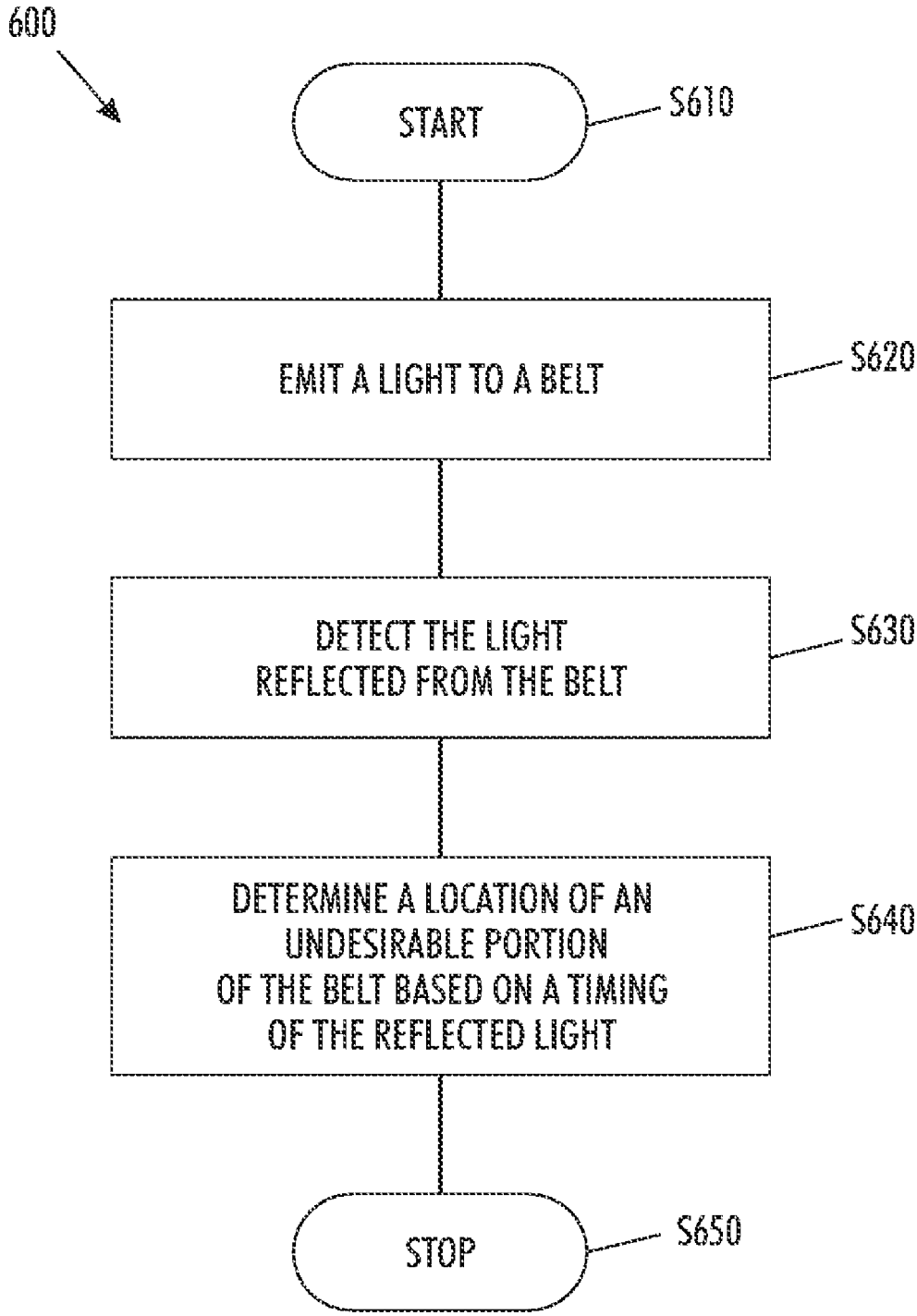
FIG. 6 shows a flowchart outlining an exemplary sensing process.

FIG. 6 shows a flowchart outlining an exemplary sensing process. The process starts at step S610, and proceeds to step S620. In step S620, an emitter of a sensor that is coupled to a belt, may emit a light onto the belt. The belt may have an undesirable portion, such as a connecting seam. Further, the belt can have an aperture, which can expose a reflector. The aperture can be located a predetermined distance from the undesirable portion. The process then proceeds to step S630.

In step S630, a detector of the sensor may detect the light reflected from the reflector. For example, the reflector can have a larger reflectivity than the belt surface. Therefore, a larger portion of the light can be reflected by the reflector. Thus, the detector can detect a larger light intensity, for example larger than a threshold, corresponding to the reflector. The process then proceeds to step S640.

In step S640, a controller may determine a location of the undesirable portion based on the reflected light, such as a detection timing of the light that is reflected from the reflector, due to the reason that the distance from the aperture to the undesirable portion can be predetermined. The process then proceeds to step S650 and terminates.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A sensor system, comprising:

a belt having an undesirable portion and an aperture formed at a distance from the undesirable portion, the undesirable portion being a defective location that forms after installation of the belt within the sensor system;

a reflector located in the aperture, wherein a length and a width of the reflector are significantly less than a respective length and a respective width of the belt, and the reflector is located at an intermediate layer of the belt; and a detector that senses a light reflected by the reflector to determine a location of the undesirable portion.

2. The sensor system according to claim 1, wherein the belt comprises at least one of a photoreceptor belt and an intermediate transfer belt.

3. The sensor system according to claim 1, wherein the undesirable portion comprises a belt seam.

4. The sensor system according to claim 1, wherein the reflector has a high reflectivity.

5. The sensor system according to claim 1, wherein the reflector is attached at a back surface of the belt.

6. The sensor system according to claim 5, wherein the reflector is a reflective sticker.

7. A method for sensing, comprising:

determining an undesirable portion on a belt;

forming an aperture on the belt at a predetermined distance from the undesirable portion;

placing a reflector in the aperture, wherein a length and a width of the reflector are significantly less than a respective length and a respective width of the belt;

emitting a light onto the belt;

detecting a light reflected from the reflector; and determining a location of the undesirable portion based on the light reflected from the reflector.

8. The method according to claim 7, wherein the belt comprises at least one of a photoreceptor belt and an intermediate transfer belt.

9. The method according to claim 7, wherein the undesirable portion comprises a belt seam.

10. The method according to claim 7, wherein the reflector has a high reflectivity.

11. The method according to claim 7, wherein the reflector is attached at a back surface of the belt.

12. The method according to claim 11, wherein the reflector includes a reflective sticker.

13. The method according to claim 7, wherein the reflector is located at an intermediate layer of the belt.

14. A printing system, comprising:

a belt having an undesirable portion and an aperture formed at a distance from the undesirable portion, the undesirable portion being a defective location that forms after installation of the belt within the printing system;

a reflector located in the aperture, wherein a length and a width of the reflector are significantly less than a respective length and a respective width of the belt, and the reflector is located at an intermediate layer of the belt;

a driver coupled to the belt to drive the belt through image forming devices to form an image on the belt;

a detector that senses a light reflected by the reflector to determine a location of the undesirable portion in order to avoid forming the image on the undesirable portion; and a system of components that print a desired image.

15. The printing system according to claim 14, wherein the belt comprises at least one of a photoreceptor belt and an intermediate transfer belt.

16. The printing system according to claim 14, wherein the undesirable portion comprises a belt seam.

17. The printing system according to claim 14, wherein the reflector has a high reflectivity.

18. The printing system according to claim 14, wherein the reflector is attached at a back surface of the belt.

19. The printing system according to claim 18, wherein the reflector includes a reflective sticker.

* * * * *